United States Patent [19]

Lowry

[11] Patent Number: 4,978,426

[45] Date of Patent: Dec. 18, 1990

[54] PRODUCTION OF HIGH STRENGTH LINERBOARD WITH OXYGEN AND ALKALI

[75] Inventor: Frank P. Lowry, Mt. Pleasant, S.C.

[73] Assignee: Westvaco Corporation, New York, N.Y.

[21] Appl. No.: 297,095

[22] Filed: Jan. 13, 1989

Related U.S. Application Data

[63] Continuation-in-part of Ser. No. 17,866, Feb. 24, 1987, abandoned.

[51] Int. Cl.[5] ..... D21C 9/10

[52] U.S. Cl. ..... 162/65; 162/90

[58] Field of Search ..... 162/65, 90

[56] References Cited

U.S. PATENT DOCUMENTS 3,832,276 8/1974 Roymoulik et al. ..... 162/65

4,363,697 12/1982 Markham et al. ..... 162/65 X

*Primary Examiner*—David A. Simmons

*Assistant Examiner*—Thi Dang

*Attorney, Agent, or Firm*—Terry B. McDaniel; Richard L. Schmalz

[57] ABSTRACT

Pulp of improved refinability for the production of high strength linerboard is obtained by digesting wood chips in alkaline cooking liquor, defibering, treating with oxygen and alkali in the absence of a cellulose protector, and refining. Linerboard pulp produced by this method results in improved paper strength properties. The treatment is conducted in its best mode at temperatures below 100° C. to minimize pulp yield losses.

7 Claims, 4 Drawing Sheets

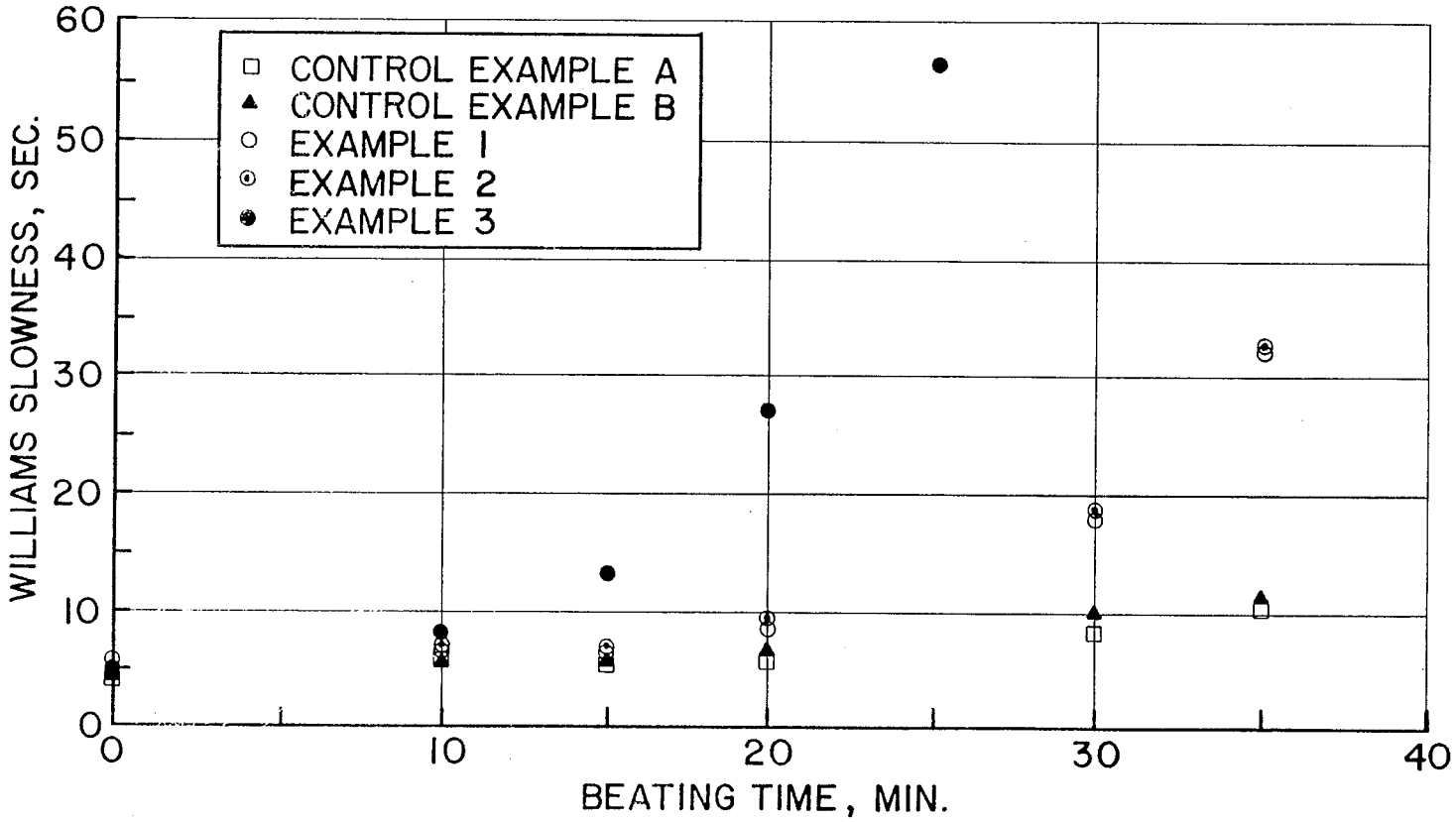
FIGURE 1. EFFECT OF VALLEY BEATING TIME ON WILLIAMS SLOWNESS LEVELS OF OXYGEN AND ALKALI TREATED PULP

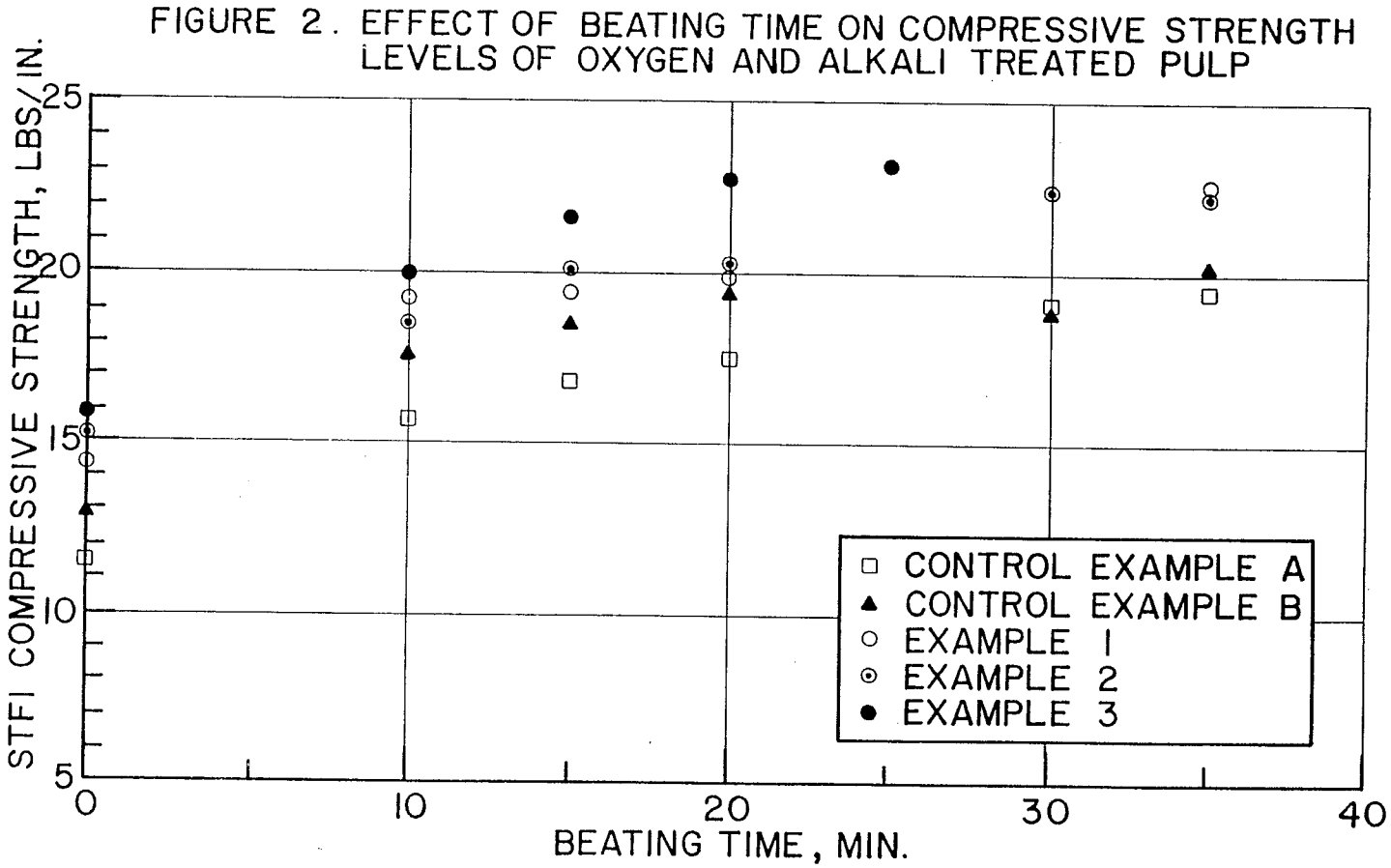
FIGURE 2. EFFECT OF BEATING TIME ON COMPRESSIVE STRENGTH LEVELS OF OXYGEN AND ALKALI TREATED PULP

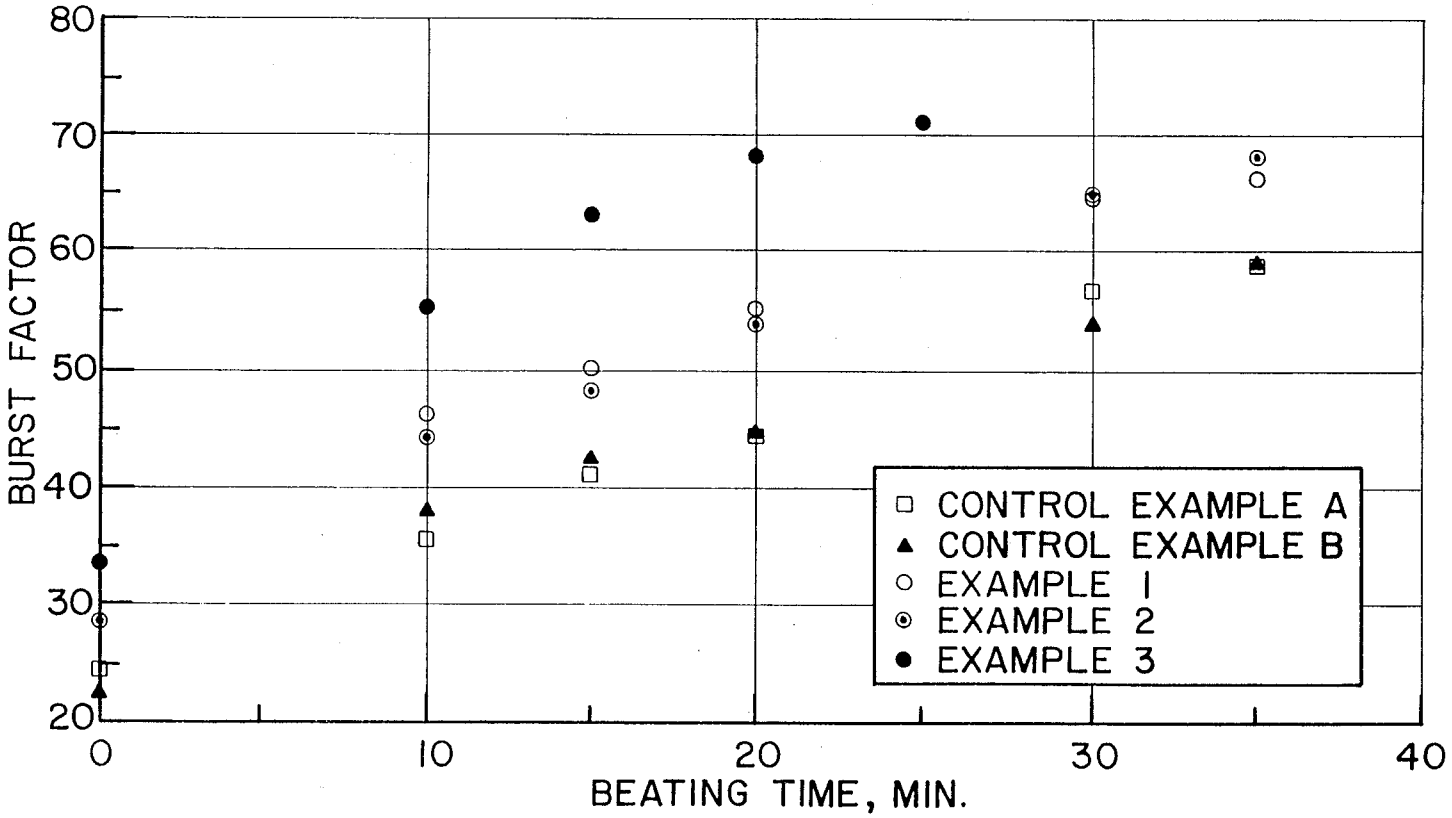
FIGURE 3. EFFECT OF BEATING TIME ON BURST FACTOR LEVELS OF OXYGEN AND ALKALI TREATED PULP

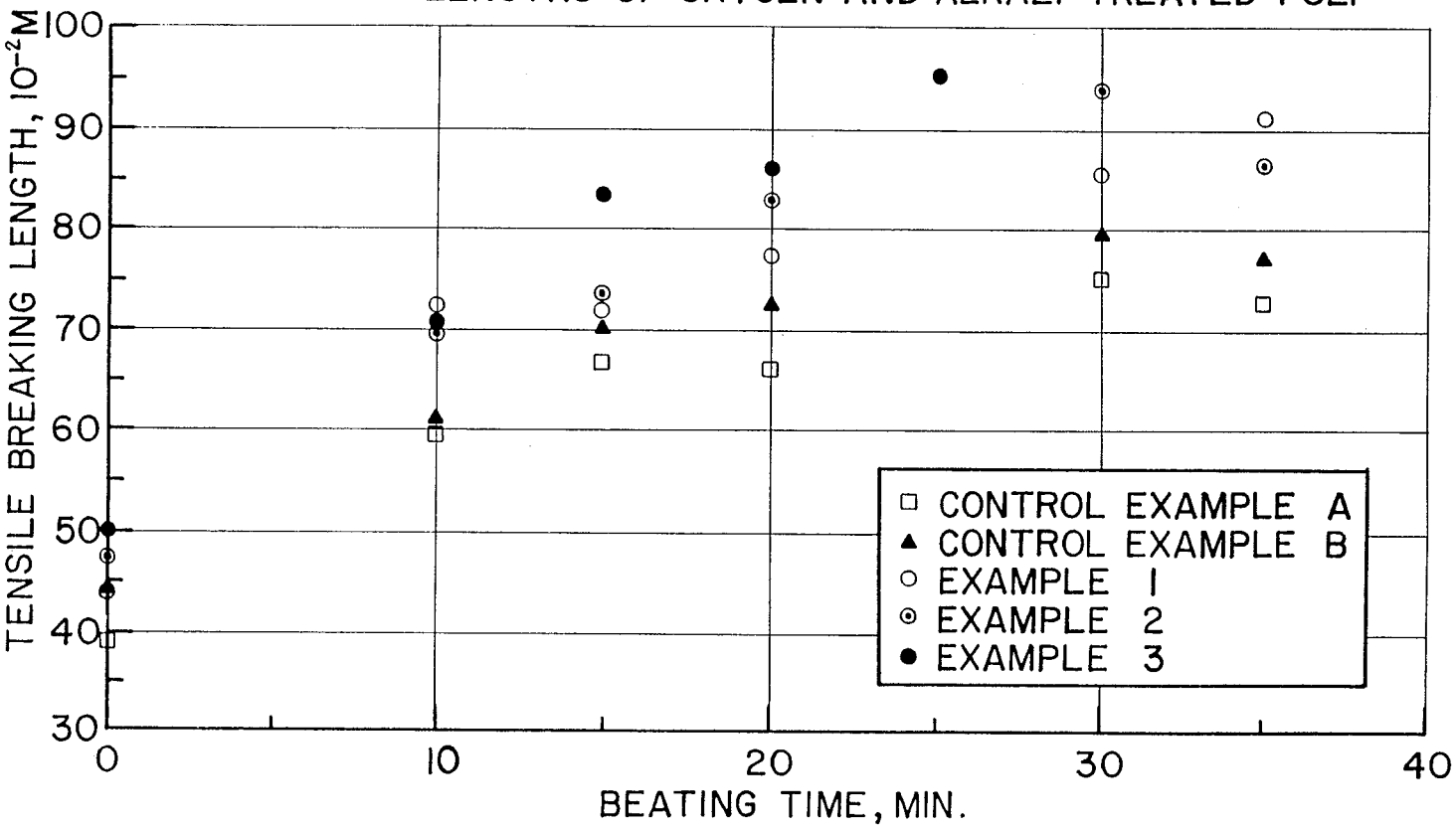
FIGURE 4. EFFECT OF BEATING TIME ON TENSILE BREAKING LENGTHS OF OXYGEN AND ALKALI TREATED PULP

PRODUCTION OF HIGH STRENGTH LINERBOARD WITH OXYGEN AND ALKALI

This application is a continuation-in-part of application Ser. No. 07/017,866, filed Feb. 24, 1987, and now abandoned.

BACKGROUND OF THE INVENTION (1) Field of the Invention

This invention relates to a method for increasing strength properties and refinability of high yield chemical wood pulp by oxygen and alkali treatment. The enhanced properties of the pulp are particularly advantageous for manufacturers of linerboard paper.

(2) Description of the Prior Art

Sulfate pulp with a lignin content corresponding to a Kappa number of from about 60 to about 120 is conventionally used for the production of unbleached linerboard. Linerboard pulp manufactured this way has good strength properties at relatively high yields (55–60%). The dry weight of washed fibers which are recovered after pulping is generally reported as a percentage of the weight of dry lignocellulosic material which was charged to the digestion process. This percentage is termed "yield." Any decrease in yield caused by loss of lignocellulosic materials is undesirable in papermaking. Two of the more important strength properties of linerboard are burst and edgewise compressive strength. To obtain the desired burst and compressive strength, pulp is refined before the linerboard is formed. The action of refining fibrillates and collapses the pulp fibers, allowing them to form a more strongly bonded and dense board. Linerboard density is strongly correlated with burst and compressive strength levels. However, the pulp cannot be refined too severely since this will cause the pulp to drain poorly on the linerboard machine, resulting in low production rates. Board density is therefore achieved by a combination of refining and wet pressing on the paper machine.

It is known generally that delignification of pulp with oxygen and alkali is a commercially accepted process. The process is usually applied to low yield chemical pulps as a pre-bleaching stage, before final bleaching with chlorine-containing chemicals. The Kappa number of the pulp is usually reduced from 30–35 to 15–20, signifying a reduction in lignin content of at least 40–50%. Reductions in lignin content to such a degree would result in paper of insufficient strength properties for linerboard manufacture. Also, such reductions in yield would be uneconomical.

Kleppe et al. ("Delignifying high yield pulps with oxygen and alkali," TAPPI, vol. 68, no. 7, p. 71, 1985) teach that sulfate pulp having a Kappa number within the range of 140–150 can be delignified with oxygen and alkali to pulp with a Kappa number of 110. In both of these treatments, however, oxygen, alkali, and pulp are reacted at temperatures (105° C.) and pressures (0.5 mPa, 58 psig) which were optimized for the removal of lignin from the pulp. Delignification rates and strength levels of high yield soda pulps are strongly influenced by temperature during oxygen and alkali treatment. Thus, reaction temperatures above 100° C. increase the extent and rate of delignification and promote oxidative degradation of wood carbohydrates.

Because of the relatively severe conditions of the above treatments, the pulps are stabilized against carbohydrate degradation by treatment with magnesium salts (0.05–0.15%, based on o.d. (oven dried) pulp). These salts, however, reduce the yield loss associated with the carbohydrate fraction of the pulp, allowing for further delignification.

An example of this approach is U. S. Pat. No. 3,657,065 to Smith et al. which specifically claims and requires the inclusion of chemical protectors to inhibit cellulose pulp degradation. The patentees teach delignification of up to 89% to result from the conditions of alkali and oxygen treatment. The instant invention seeks to minimize the degree of delignification resulting from the treatment of a chemical wood pulp with oxygen and alkali, as well as to minimize cellulose degradation without reliance on chemical protectors.

It is the object of this invention, therefore, to provide an improved method of linerboard paper production to provide an industrial means to produce high strength kraft linerboard requiring reduced refining energy, by treating high yield chemical wood pulp with oxygen and alkali at a temperature of from about 50° C. to about 100° C. and a pressure of up to 150 psig.

SUMMARY OF THE INVENTION

The instant invention achieves the above objective by an improved linerboard manufacture method which, in the absence of cellulose protectors, uses oxygen and alkali as a means to chemically modify residual lignin present in high yield sulfate pulp without a substantial decrease in pulp yield as evidenced by a kappa number reduction (from the untreated pulp) no greater than 25%. The process conditions utilized in this invention are much less severe than those used in prior art oxygen and alkali delignification processes resulting in minimized lignin and carbohydrate loss.

BRIEF DESCRIPTION OF THE DRAWINGS

The figures present graphs which illustrate the ability to control linerboard pulp properties by regulating the beating time of pulps treated according to the present invention.

FIG. 1 shows the relationship between the oxygen and alkali treatment of pulp and Williams Slowness at different beating times.

FIG. 2 shows the relationship between the oxygen and alkali treatment of pulp and linerboard compressive strength at different beating times.

FIG. 3 shows the relationship between the oxygen and alkali treatment of pulp and linerboard burst factor at different beating times.

FIG. 4 shows the relationship between the oxygen and alkali treatment of pulp and linerboard tensile breaking lengths at different beating levels.

DESCRIPTION OF THE PREFERRED EMBODIMENT

It has been discovered that a high strength kraft linerboard can be accomplished by subjecting industrially prepared kraft pulp to a mild oxygen and alkali treatment. The oxygen and alkali treatment of a high yield (55–60%) pulp produced from wood chips cooked in an alkaline cooking liquor allows production of a linerboard grade of paper with higher densities and physical strength levels than conventionally prepared linerboard. Upon refining, the oxygen and alkali treated pulp reach a given Williams Slowness and strength level more quickly than untreated pulp, indicating that treated pulp is easier to refine than conventional linerboard pulp. (The Williams Slowness is the amount of time in seconds for one liter of water to drain through a three-gram sample of pulp.) The oxygen and alkali treatment is carried out on a pulp of medium consistency (8–20%, preferably 12%) at lower temperatures and pressures than those used in conventional oxygen delignification processes and in the absence of cellulose protectors. Employment of the pulp produced by this process in linerboard results in linerboard strength properties (burst, density, compressive strength) significantly higher than that measured in linerboard employing conventional (untreated) kraft pulp of the same Kappa number. The process has the effect of modifying the residual lignin present in high yield kraft pulp rather than substantially reducing pulp yield through lignin dissolution as is conventionally practiced with oxygen and alkali processes.

The invention is described in more detail by the following tables and figures which summarize laboratory experiments in which industrial and laboratory prepared linerboard pulps were treated with oxygen and alkali.

CONTROL EXAMPLE A

This pulp was an industrially produced kraft southern pine pulp with a Kappa number of 96.5. The pulp was washed in the laboratory which reduced the Kappa number to 87.7. The pulp was then beaten in a Valley Beater to various Williams Slowness levels and test handsheets were made.

CONTROL EXAMPLE B

The same pulp as in Control Example A was treated in a laboratory oxygen reactor for one hour at 78° C. in the absence of oxygen. The pulp consistency was 12% and the initial pH was 10.9. After the treatment the pulp was washed and the Kappa number determined. The pulp was then beaten in a Valley Beater to various Williams Slowness levels, and test handsheets were made.

EXAMPLE 1

The same pulp as in Control Example A was mixed with sodium hydroxide solution and sufficient water to bring the pulp consistency to 12%. The sodium hydroxide charge was 1% based on the o.d. weight of the pulp. The initial pH of the pulp was 12.1. The pulp was then treated in a laboratory oxygen reactor for one hour at 78° C. with an oxygen pressure of 15 psig. After the treatment, the pulp was washed, and the Kappa number was determined to be 81.1 (a 7.5% reduction). The pulp was then beaten in a Valley Beater to various Williams Slowness levels and test handsheets were made. The pH of the pulp after the treatment was 10.3.

EXAMPLE 2

The same pulp as in Control Example A was mixed with sodium hydroxide solution and sufficient water to bring the pulp consistency to 12%. The sodium hydroxide charge was 2% based on o.d. pulp weight. The initial pH of the pulp was 12.2. The pulp was then treated in a laboratory oxygen reactor for one hour at 78° C. with an oxygen pressure of 15 psig. After treatment the pulp was washed and the Kappa number determined to be 77.1 (a 12% reduction). The pulp was then beaten in a Valley Beater to various Williams Slowness levels, and test handsheets were made. The pH of the pulp after the treatment was 10.9.

EXAMPLE 3

The same pulp as in Control Example A was mixed with sodium hydroxide solution and sufficient water to bring the pulp consistency to 12%. The sodium hydroxide charge was 5% based on o.d. pulp weight. The initial pH of the pulp was 13.0. The pulp was then treated in a laboratory oxygen reactor for one hour at 78° C. and an oxygen pressure of 15 psig. After treatment the pulp was washed and the Kappa number determined to be 68.2 (a 22.2% reduction). The pulp was then beaten in a Valley Beater to various Williams Slowness levels, and test handsheets were made.

The beating times, William Slowness, handsheet densities, and pulp strength properties are shown in Table I.

TABLE I

EFFECT OF OXYGEN-ALKALI ON STRENGTH PROPERTIES OF KRAFT PINE PULPS

| Beating Time (min.) | Williams Slowness (sec.) | Handsheet Density (kg/m$^3$) | STFI Compressive Strength (lb./in.) | Burst Factor | Tensile Breaking Length ($10^{-2}$m) |
|---|---|---|---|---|---|
| | | | Control Example A | | |
| 0 | 4.3 | 409 | 11.5 | 24.0 | 39.1 |
| 10 | 5.8 | 483 | 15.8 | 36.0 | 59.4 |
| 15 | 6.0 | 510 | 16.9 | 41.7 | 67.9 |
| 20 | 6.3 | 549 | 17.5 | 44.2 | 67.2 |
| 30 | 8.6 | 610 | 19.2 | 57.0 | 75.3 |
| 35 | 10.9 | 645 | 19.5 | 58.5 | 73.3 |
| | | | Control Example B | | |
| 0 | 4.6 | 444 | 12.9 | 22.7 | 44.8 |
| 10 | 5.8 | 500 | 17.8 | 38.8 | 61.8 |
| 15 | 6.4 | 541 | 18.8 | 43.3 | 70.3 |
| 20 | 7.2 | 571 | 19.4 | 44.7 | 72.5 |
| 30 | 10.1 | 602 | 18.9 | 54.0 | 79.6 |
| 35 | 11.6 | 645 | 20.4 | 58.7 | 77.4 |
| | | | Example 1 | | |
| 0 | 5.5 | 465 | 14.4 | 28.7 | 44.6 |
| 10 | 6.8 | 552 | 19.3 | 46.1 | 72.8 |
| 15 | 7.8 | 585 | 19.5 | 50.4 | 72.1 |
| 20 | 9.2 | 606 | 19.9 | 55.2 | 77.7 |
| 30 | 18.7 | 667 | 22.3 | 64.3 | 86.5 |
| 35 | 33.0 | 685 | 22.6 | 66.7 | 91.8 |
| | | | Example 2 | | |
| 0 | 5.1 | 467 | 15.2 | 28.7 | 48.7 |
| 10 | 6.5 | 549 | 18.6 | 44.5 | 69.8 |
| 15 | 7.5 | 592 | 20.2 | 48.3 | 74.3 |
| 20 | 9.9 | 621 | 20.3 | 54.2 | 83.5 |
| 30 | 19.3 | 676 | 22.3 | 64.6 | 94.5 |
| 35 | 33.4 | 699 | 22.2 | 68.0 | 86.8 |
| | | | Example 3 | | |
| 0 | 5.0 | 505 | 15.9 | 33.9 | 50.7 |
| 10 | 7.9 | 633 | 20.0 | 55.3 | 70.1 |
| 15 | 13.5 | 699 | 21.8 | 63.8 | 84.0 |
| 20 | 27.1 | 733 | 22.9 | 68.8 | 86.0 |
| 25 | 57.0 | 769 | 23.2 | 71.6 | 95.3 |

As seen from the examples, treatments of pulp with oxygen and alkali produced pulps with higher sheet densities and strength properties in the unbeaten state (0 minutes beating time) than untreated pulps. FIG. 1 shows the beating times plotted against Williams Slowness. Upon a study of FIG. 1 it becomes evident that the oxygen and alkali treatment allows the pulp to reach a given slowness with a lower amount of beating. On an industrial scale, this result translates into decreased refining energy for equivalent pulp slowness levels. Control Example B shows that some of the strength increases are due to mechanical treatment received by the pulp in the laboratory oxygen reactor. However, these increases are significantly lower than those found after the addition of oxygen and alkali.

As seen from Table II, the oxygen and alkali treated pulp was significantly higher in compressive strength,

TABLE II

COMPARISON OF OXYGEN AND ALKALI TREATED PINE PULPS WITH KRAFT PULPS OF SIMILAR AND DIFFERENT KAPPA NUMBERS
Treatment Conditions:
Laboratory Pine Pulp Prepared from Charleston Pine Chips
12% Consistency
78° C.
One Hour Reaction Time
5% NaOH Applied to Oxygen-Alkali Treated Pulp
15 psig Oxygen

| Treatment Description | Beating Time (min.) | Williams Slowness (sec.) | Sheet Density (g/cc) | STFI Compressive Strength (lb./in.) | Tensile Breaking Length ($10^{-2}$) | Burst Factor | Tear Factor |
|---|---|---|---|---|---|---|---|
| Control Example C (Kappa No. 98.1) | 0 | 5.1 | 0.383 | 10.1 | 32.1 | 17.3 | 214.3 |
| | 10 | 5.7 | 0.485 | 14.6 | 57.1 | 37.9 | 262.6 |
| | 15 | 5.9 | 0.516 | 16.2 | 63.3 | 41.5 | 263.4 |
| | 20 | 6.9 | 0.558 | 17.3 | 70.2 | 47.5 | 236.9 |
| | 30 | 9.4 | 0.637 | 20.1 | 86.3 | 58.3 | 220.0 |
| | 35 | 12.2 | 0.665 | 20.5 | 86.5 | 63.5 | 209.8 |
| Control Example D (Kappa No. 68.6) | 0 | 5.3 | 0.445 | 11.7 | 38.4 | 21.9 | 272.0 |
| | 10 | 5.6 | 0.550 | 16.2 | 65.8 | 41.3 | 304.7 |
| | 15 | 6.6 | 0.610 | 18.4 | 73.1 | 50.1 | 272.3 |
| | 20 | 7.9 | 0.640 | 19.9 | 80.2 | 58.6 | 259.2 |
| | 30 | 14.1 | 0.713 | 21.5 | 92.2 | 69.9 | 224.3 |
| | 35 | 24.8 | 0.732 | 22.4 | 98.6 | 73.0 | 215.8 |
| Oxygen-Alkali Treated Example 4 (Kappa No. 75.5) | 0 | 5.1 | 0.492 | 14.5 | 40.5 | 32.0 | 294.6 |
| | 10 | 6.6 | 0.599 | 18.9 | 69.0 | 51.0 | 250.4 |
| | 15 | 7.8 | 0.652 | 19.7 | 77.3 | 59.9 | 230.7 |
| | 20 | 9.7 | 0.680 | 20.8 | 82.1 | 63.5 | 210.5 |
| | 30 | 23.5 | 0.743 | 22.6 | 94.7 | 69.8 | 196.1 |
| | 35 | 40.5 | 0.779 | 23.7 | 99.6 | 75.0 | 185.5 |

Increases in the sodium hydroxide charge in the presence of oxygen improved pulp strength properties and lowered the beating times required to achieve a given strength and slowness level. This can be determined from a study of FIGS. 2, 3, and 4. The most significant improvements were observed with a caustic application of 5% based on the o.d. weight of pulp.

Another result of the oxygen-alkali treatment was a reduction in pulp Kappa number. As shown in the following examples, the degree of Kappa number reduction was directly related to the sodium hydroxide charge.

A comparison of the strength properties of oxygen and alkali treated laboratory pulp with the same pulp cooked to a Kappa number similar to that of the oxygen and alkali treated pulp is shown in Table II.

CONTROL EXAMPLE C

This pulp is a laboratory prepared kraft southern pine pulp with a washed Kappa number of 98.1. The pulp was then beaten in a Valley Beater to various Williams Slowness levels and test handsheets were made.

CONTROL EXAMPLE D

This pulp is a laboratory prepared kraft southern pine pulp with a washed Kappa number of 68.6. The pulp was then beaten in a Valley Beater to various Williams Slowness levels and test handsheets were made.

EXAMPLE 4

The same pulp as in Control Example C was mixed with sodium hydroxide solution and sufficient water to bring the pulp consistency to 12%. The sodium hydroxide charge was 5% based on o.d. pulp weight. The initial pH of the pulp was 13.0. The pulp was then treated in a laboratory reactor for one hour at 78° C. with an oxygen pressure of 15 psig. After the treatment the pulp was washed and the Kappa number was determined to be 75.5. the pulp was then beaten in a Valley Beater to various Williams Slowness levels, and test handsheets were made. The pH of the pulp after treatment was 11.5.

burst factor, breaking length, and handsheet density when compared to the two kraft pulp at constant beating time. It is evident, therefore, that strength properties are more favorably enhanced by oxygen and alkali treatment than by an equivalent reduction in pulp Kappa number achieved through kraft pulping changes.

While this invention has been described and illustrated herein by reference to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. A method for producing linerboard paper from high yield chemical wood pulp having a kappa number from about 60 to about 120 by treating the pulp with oxygen and alkali at a temperature of from about 50° C. to about 100° C. and a pressure of up to about 150 psig in the absence of protectors to increase the refinability of the pulp and the strength properties of the paper by limiting the reduction in lignin and carbohydrate content int he pulp as determined by a kappa number reduction of no greater than 25% in the treated pulp.

2. The method of claim 1 wherein the pulp is a sulfate pulp.

3. The method of claim 1 wherein the chemical wood pulp is prepared from the digestion of lignocellulose materials in alkaline cooking liquor.

4. The method of claim 1 wherein the alkali is charged to the pulp prior to reaction with oxygen.

5. The method of claim 1 wherein the alkali is added in an amount from about 0.5% to about 5%, based on the oven dried weight of the pulp.

6. The method of claim 1 wherein the temperature is 78° C. and the pressure is 15 psig.

7. The method of claim 1 wherein the pulp has a consistency of 8–20%.

* * * * *